United States Patent [19]

Dillon

[11] Patent Number: 4,647,288

[45] Date of Patent: Mar. 3, 1987

[54] HYDROCARBON FUEL COMPOSITION CONTAINING ORTHOESTER AND CYCLIC ALDEHYDE POLYMER

[75] Inventor: Diane M. Dillon, Fullerton, Calif.

[73] Assignee: Union Oil Company of California, Los Angeles, Calif.

[21] Appl. No.: 771,553

[22] Filed: Aug. 30, 1985

[51] Int. Cl.[4] ..... C10L 1/18

[52] U.S. Cl. ..... 44/52; 44/56; 44/57; 44/63; 44/70; 44/77

[58] Field of Search ..... 44/52, 56, 57, 63, 70, 44/77

[56] References Cited

U.S. PATENT DOCUMENTS

| | | | |
|---|---|---|---|
| 2,821,538 | 1/1958 | Dille et al. | 252/56 R |
| 2,916,366 | 12/1959 | Heinrich et al. | 44/56 |
| 4,390,344 | 6/1983 | Sweeney | 44/56 |
| 4,395,267 | 7/1983 | Sweeney | 44/56 |
| 4,397,655 | 8/1983 | Sweeney | 44/77 |

FOREIGN PATENT DOCUMENTS

| | | |
|---|---|---|
| 1568648 | 6/1980 | United Kingdom . |

*Primary Examiner*—Mrs. Y. Harris-Smith

*Attorney, Agent, or Firm*—Dean Sanford; Gregory F. Wirzbicki; Michael C. Schiffer

[57] ABSTRACT

Hydrocarbon fuels, especially diesel fuel compositions, contain cyclic aldehyde polymers and orthoesters to reduce particulate emissions therefrom when combusted in an internal combustion engine.

39 Claims, No Drawings

HYDROCARBON FUEL COMPOSITION CONTAINING ORTHOESTER AND CYCLIC ALDEHYDE POLYMER

BACKGROUND OF THE INVENTION

This invention relates to organic particulate emissions suppressant additives and hydrocarbon fuels containing the additives. These additives are useful for reducing soot, smoke and particulate emissions from hydrocarbon fuels.

The petroleum industry has encountered numerous problems in supplying hydrocarbon fuels, especially middle distillate fuels suitable for use in compression ignition and jet engines. One problem associated with combustion of hydrocarbon fuels in these engines is that they contribute materially to pollution of the atmosphere through soot, smoke and particulate emissions in engine exhaust gases.

Soot is the particulate matter resulting from heterogeneous combustion of hydrocarbon fuels, especially middle distillate fuels, such as diesel fuels, and residual fuels, such as heating oils. When present in sufficient particle size and quantity, soot in engine exhaust gases appears as a black smoke. Soot formation in engine exhaust gases is highly undesirable since it causes environmental pollution, engine design limitations and possible health problems.

Diesel-type engines are well known for being highly durable and reliable under severe operating conditions. Because of this durability and reliability, diesel-type engines have long been used in heavy-duty motor vehicles, such as trucks, buses and locomotives. Recently, however, the automotive industry is using diesel-type engines in passenger automobiles and light-duty trucks to achieve greater fuel economy and conserve petroleum fuel. This increased use of diesel-type engines materially adds to pollution of the atmosphere through increased soot, smoke and particulate emissions in engine exhaust gases.

Several attempts have been made to reduce emissions from diesel-type engines through the use of additives to middle distillate fuels. For example, U.S. Pat. No. 3,817,720 relates to organic smoke suppressant additives and distillate hydrocarbon fuels containing the same. The preferred organic additives are ethers of hydroquinone. These compounds are ethers of phenolic-type compounds which contain two oxygen atoms attached to each phenyl moiety.

Another hydrocarbon fuel additive, disclosed in U.S. Pat. No. 4,302,214, is a diether compound having low molecular weight. These compounds are described as suitable for increasing the octane number of gasoline.

The suppression of particulate emissions from diesel engines is described in U.S. Pat. No. 4,240,802 which discloses the addition of a minor amount of a cyclopentadienyl manganese tricarbonyl and a lower alkyl or cycloalkyl nitrate to a hydrocarbon fuel. These compounds are described as useful in reducing particulate emissions of fuel oil.

It is an object of the present invention to provide hydrocarbon fuel compositions having enhanced particulate emissions suppressant properties.

Another object of the present invention is to provide a middle distillate fuel composition having reduced soot and smoke emissions properties.

Other objects and advantages of the invention will be apparent from the following description.

SUMMARY OF THE INVENTION

The present invention resides in a hydrocarbon fuel composition having particulate emissions suppressant properties which comprises a hydrocarbon fuel and a particulate reducing amount of at least one cyclic aldehyde polymer and of at least one orthoester.

DETAILED DESCRIPTION OF THE INVENTION

The present invention resides in a hydrocarbon fuel having particulate emissions suppressant properties. For the purposes of the present invention, a hydrocarbon fuel shall mean either a liquid or gaseous hydrocarbon fuel. In particular, the present invention relates to hydrocarbon fuel compositions comprising at least one cyclic aldehyde polymer and at least one orthoester so as to reduce the particulate emissions resulting from the combustion of the hydrocarbon fuel. It should be noted that reference to cyclic aldehyde polymer or orthoester is inclusive of both a single species of cyclic aldehyde polymer or orthoester and to a mixture of species of cyclic aldehyde polymers or orthoesters.

Preferably the cyclic aldehyde polymer is of the formula:

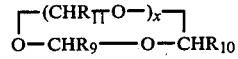

where $R_9$, $R_{10}$, and $R_{11}$ are the same or different and are hydrogen or a $C_1$ to $C_{10}$ organic radical and x is from 0 to 4. When x is 2 or more, $R_{11}$ may be the same or different organic radical in each repeating segment. Preferably, $R_9$, $R_{10}$, and $R_{11}$ are the same or different aliphatic, alicyclic, or aromatic derived radicals, more preferably alkyl, alkenyl, or alkynyl radicals.

Examples of suitable cyclic aldehyde polymers are 1,3,5-trioxane; 2,4,6-trimethyl-1,3,5-trioxane; 2,4,6-tripropyl-1,3,5-trioxane; and 2,4,6,8-tetramethyl-1,3,5,7-tetroxocane.

One method by which cyclic aldehyde polymers may be prepared is by heating aldehydes in the presence of an acid catalyst.

Preferably the orthoester is of the formula:

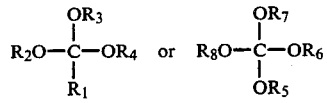

(I) (II)

where $R_1$ is hydrogen or a monovalent organic radical comprising from 1 to about 20 carbon atoms and $R_2$, $R_3$, $R_4$, $R_5$, $R_6$, $R_7$, and $R_8$ are the same or different monovalent organic radicals comprising from 1 to about 20 carbon atoms.

Preferably, $R_1$, $R_2$, $R_3$, $R_4$, $R_5$, $R_6$, $R_7$, and $R_8$ are the same or different monovalent radicals derived from an aliphatic, alicyclic or aromatic compound comprising from 1 to about 10 carbon atoms. Still more preferably $R_1$, $R_2$, $R_3$, $R_4$, $R_5$, $R_6$, $R_7$, and $R_8$ are the same or different monovalent radical derived from an aliphatic or alicyclic compound comprising from 1 to about 10 carbon atoms and still more preferably the same or different alkyl, alkenyl or alkynyl radical comprising from 1 to about 10 carbon atoms.

Examples of an orthoester of the formula I type are trimethyl orthoacetate, dimethylethyl orthoacetate, diethylmethyl orthoacetate, di-n-propylethyl orthoacetate, di-n-butylethyl orthoacetate, trimethyl orthopropionate, trimethyl orthobutyrate, dimethylpentyl orthoformate, trimethyl orthoisobutyrate, diethylmethyl orthohexanoate, diisobutylethyl orthoformate, trimethyl orthocyclohexanecarboxylate, trimethyl ortho-para-toluate, and trimethyl orthobenzoate. The preferred orthoester of the formula I type is trimethyl orthoacetate.

Examples of orthoesters of the formula II type are a tetraalkyl orthocarbonate, such as tetramethyl orthocarbonate, tetraethyl orthocarbonate, tetrapropyl orthocarbonate, tetrabutyl orthocarbonate, trimethylbutyl orthocarbonate, dimethyldibutyl orthocarbonate, or tetra-n-hexyl orthocarbonate, or other orthocarbonates, such as tetraphenyl orthocarbonate. The preferred orthoester of the formula II type is tetramethyl orthocarbonate.

Generally, the composition is comprised of a hydrocarbon fuel and a sufficient amount of at least one cyclic aldehyde polymer and at least one orthoester to reduce the particulate emissions from the combustion of the fuel. Preferably, the cyclic aldehyde polymer in the fuel comprises from about 0.1 to about 50 weight percent of the total amount of cyclic aldehyde polymer and orthoester. The cyclic aldehyde polymer and orthoester are usually present from about 0.05 to about 49 volume percent, preferably from about 0.05 to about 10 volume percent, and more preferably from about 0.1 to about 5 volume percent based upon the total volume of fuel, cyclic aldehyde polymer, and orthoester. Typically, the cyclic aldehyde polymer, which is normally present as a solid, is admixed into the orthoester and this mixture is admixed by dissolution into the hydrocarbon fuel. When the cyclic aldehyde polymer and orthoester are admixed into a liquid hydrocarbon fuel, particularly a middle distillate fuel, it may be difficult to dissolve large concentrations of the cyclic aldehyde polymer into the fuel. Thus, with middle distillate fuels, the preferred amount of cyclic aldehyde polymer and orthoester is from about 0.05 to about 10 volume percent.

As stated above, hydrocarbon fuels useful for the practice of the present invention include both liquid and gaseous hydrocarbon fuels, such as residual fuels, petroleum middle distillate fuels, methane, ethane, propane, acetylene, or natural gas. It should be noted that any hydrocarbon fuel in which the cyclic aldehyde polymer in combination with the orthoester can be admixed to prepare a composition in accordance with the present invention is suitable for the purposes of the present invention. Preferably, the hydrocarbon fuel is a petroleum middle distillate fuel, residual fuel, propane or acetylene, and more preferably diesel fuel or residual fuel.

A preferred hydrocarbon fuel of this invention is generally classified as a petroleum middle distillate fuel boiling in the range of 350° F. to 700° F. The most common petroleum middle distillate fuels are kerosene, diesel fuels, aviation fuels, and some heating oils. Residual fuels, which are also a preferred hydrocarbon fuel, include heating oils, such as Grade No. 4 and 6 heating fuels.

The hydrocarbon fuel composition of the present invention may also comprise any of the known conventional additives, such as carburetor detergents, dyes, oxidation inhibitors, etc.

The following Examples serve to further illustrate and instruct one skilled in the art the best mode of practicing this invention and are not intended to be construed as limiting thereof.

EXAMPLE 1

Trimethyl orthoacetate (TMOA) is produced by adding a cooled mixture (32° F.) of 135 grams of acetonitrile, 109 grams of anhydrous methyl alcohol, 85 grams of anhydrous diethyl ether and 40 grams of dry hydrogen chloride to a 1-liter Pyrex glass flask. This mixture is allowed to stand in a refrigerator overnight at 32° F., during which the mixture solidifies into a cake of white, shining plates. The ether is decanted from the product and the product is dried under vacuum (1.0 mm Hg) over sodium lime for twenty-four hours to remove excess hydrogen chloride. The reaction produces the intermediate reaction product acet-imino-methyl-ether hydrochloride.

Next, 310 grams of acet-imino-methyl-ether hydrochloride, absolutely dry and free of hydrogen chloride is reacted with 409 grams of methyl alcohol in a 2-liter tightly stoppered Pyrex glass flask at room temperature with occasional shaking. Ammonium chloride formed in the reaction is removed by filtration. The filtrate is contacted with 2 grams of fused potassium carbonate to remove free hydrogen chloride. The reaction product is fractionated under a vacuum of 50 mm Hg at a temperature of 87° F. to recover trimethyl orthoacetate.

EXAMPLES 2 THROUGH 16

The following examples demonstrate the reduction of particulate emissions from the combustion of a gaseous hydrocarbon fuel, propane, containing trimethyl orthoacetate (TMOA), as prepared in Example 1, and trioxane (TOX). The procedure for measuring the particulate emissions involves combusting the propane in a laminar diffusion flame which is generated and stabilized using a 1.9 centimeter (cm) diameter capillary burner. The burner consists of three concentrically positioned stainless steel tubes which have respective inner diameters of 0.4 millimeters (mm), 1.1 mm and 1.8 centimeters. Positioned within and between these tubes are stainless steel hypodermic tubes (0.84 mm). Propane, the desired amount of trioxane and trimethyl orthoacetate, and nitrogen are provided through the central tube with oxygen and nitrogen provided through the middle tube. Through the outer concentric tube, a shroud of nitrogen is provided to shield the flame from atmospheric oxygen. The oxygen, nitrogen, and propane are metered into the tubes of the burner through calibrated glass rotometers. The total flow rates of oxygen and nitrogen for all of the examples is 0.96 and 2.35 liters per minute (l/min), respectively. Particulate emission rates are measured as a function of the propane flow rate as listed below in Table 1 for each example. The trioxane and trimethyl orthoacetate are added through a 90° "pneumatic" nebulizer and monitored with a motorized syringe pump. The flow rate for the total trimethyl orthoacetate and trioxane combination in microliters per minute (ml/min), mole percent (M%) of TMOA and TOX, and test durations for each example are listed below in Table 1. Fuels were also run using no additive and using only trimethyl orthoacetate in order to provide a comparison with the present invention. The burner is enclosed in a circular cross-sectional quartz chimney (7 cm inner diameter by 45 cm long) which is fitted with a filter holder for collecting particulate emissions.

While the following examples demonstrate the invention using propane as the hydrocarbon fuel, a reduction of particulate emissions would be demonstrated upon the combustion of other fuels comprising a particulate reducing amount of a cyclic aldehyde and orthoester. The invention is advantageously employed with fuels exhibiting relatively high particulate emissions, such as middle distillate fuels. Thus, while the invention finds use in reducing particulate emissions from the combustion of any hydrocarbon fuel, it is particularly preferable when the fuel is a middle distillate fuel (i.e. diesel fuel).

The particulate emission rates are measured by drawing the exhaust out of the chimney through a fluorocarbon-coated glass fiber filter using a rotary vane vacuum pump. The weight of particulate matter collected on the filter is determined by weighing the filter before and after the test and subtracting the former from the latter.

The mole percent (M%) of trimethyl orthoacetate and trioxane used and the results of the particulate emissions measurement for each example are listed below in Table 2.

TABLE 1

| Example | Flow Rate Propane (l/min) | Flow Rate TMOA and TOX (ml/min) | Mole % TMOA | Mole % TOX | Test Duration (Minutes) |
|---|---|---|---|---|---|
| 2 | 0.20 | 0 | 0 | 0 | 5 |
| 3 | 0.20 | 12.75 | 0.82 | 0.63 | 5 |
| 4 | 0.20 | 26.33 | 1.67 | 1.29 | 5 |
| 5 | 0.20 | 12.75 | 1.10 | 0 | 5 |
| 6 | 0.20 | 26.33 | 2.24 | 0 | 5 |
| 7 | 0.23 | 0 | 0 | 0 | 5 |
| 8 | 0.23 | 12.75 | 0.74 | 0.57 | 5 |
| 9 | 0.23 | 26.33 | 1.51 | 1.17 | 5 |
| 10 | 0.23 | 12.75 | 0.99 | 0 | 5 |
| 11 | 0.23 | 26.33 | 2.02 | 0 | 5 |
| 12 | 0.25 | 0 | 0 | 0 | 5 |
| 13 | 0.25 | 12.75 | 0.67 | 0.52 | 5 |
| 14 | 0.25 | 26.33 | 1.37 | 1.06 | 5 |
| 15 | 0.25 | 12.75 | 0.90 | 0 | 5 |
| 16 | 0.25 | 26.33 | 1.84 | 0 | 5 |

TABLE 2

| Example No. | Mole % TOX | Mole % TMOA | Mean Soot Collection Rate (Milligrams/minute) | No. of Runs | Soot Reduction (percent) |
|---|---|---|---|---|---|
| 2 | 0 | 0 | 9.86 | 12 | 0 |
| 3 | 0.63 | 0.82 | 9.55 | 3 | 3.1 |
| 4 | 1.29 | 1.67 | 9.40 | 3 | 4.7 |
| 5 | 0 | 1.10 | 9.42 | 4 | 4.4 |
| 6 | 0 | 2.24 | 9.65 | 7 | 2.1 |
| 7 | 0 | 0 | 11.47 | 30 | 0 |
| 8 | 0.57 | 0.74 | 11.02 | 3 | 3.9 |
| 9 | 1.17 | 1.51 | 10.96 | 7 | 4.5 |
| 10 | 0 | 0.99 | 11.13 | 10 | 2.9 |
| 11 | 0 | 2.02 | 10.83 | 8 | 5.5 |
| 12 | 0 | 0 | 11.05 | 37 | — |
| 13 | 0.52 | 0.67 | 10.79 | 4 | 2.4 |
| 14 | 1.06 | 1.37 | 10.44 | 7 | 5.5 |
| 15 | 0 | 0.90 | 10.68 | 6 | 3.4 |
| 16 | 0 | 1.84 | 10.20 | 9 | 7.7 |

As seen above in Table 2, the TOX and TMOA combination does effect a reduction in particulate emissions over those runs without any additive (Examples 2, 7, and 12). Furthermore, Examples 4 and 8 exhibit better soot reduction than Examples 6 and 10, respectively, with the latter only using TMOA. It should be noted that as the loading of TOX and TMOA increases soot reduction increases, as seen from a comparison of high loadings in Examples 4, 9, and 14 with low loadings in Examples 3, 8, and 13, respectively.

Obviously, many modifications and variations of the invention, as hereinbefore set forth, may be made without departing from the spirit and scope thereof, and therefore only such limitations should be imposed as are indicated in the appended claims.

What is claimed is:

1. A composition comprising: a gaseous or liquid hydrocarbon fuel; and a particulate reducing amount of at least one cyclic aldehyde polymer and at least one orthoester.

2. The composition of claim 1 wherein the orthoester is of the formulae:

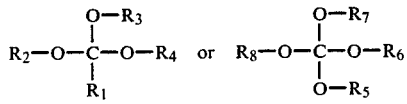

wherein $R_1$ is hydrogen or a monovalent $C_1$ to $C_{20}$ organic radical and $R_2$, $R_3$, $R_4$, $R_5$, $R_6$, $R_7$, and $R_8$ are the same or different $C_1$ to $C_{20}$ monovalent organic radical.

3. The composition of claim 2 wherein the cyclic aldehyde polymer is of the formula:

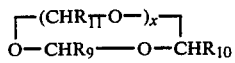

where $R_9$, $R_{10}$, and $R_{11}$ are hydrogen or the same or different $C_1$ to $C_{10}$ organic radical and x is from 0 to 4, wherein when x is 2 to 4 $R_{11}$ is the same or different $C_1$ to $C_{10}$ organic radical for each repeating segment.

4. The composition of claim 3 wherein the cyclic aldehyde polymer is from about 0.1 to about 50 weight percent of the total amount of cyclic aldehyde polymer and orthoester.

5. The composition of claim 4 wherein the total amount of cyclic aldehyde polymer and orthoester is from about 0.05 to about 49 volume percent of the total volume of hydrocarbon fuel, cyclic aldehyde polymer and orthoester.

6. The composition of claim 4 wherein the total amount of cyclic aldehyde polymer and orthoester is from about 0.05 to about 10 volume percent of the total volume of the hydrocarbon fuel, cyclic aldehyde polymer, and orthoester.

7. The composition of claim 4 wherein the total amount of cyclic aldehyde polymer and orthoester is from about 0.1 to about 5 volume percent of the total volume of hydrocarbon fuel, cyclic aldehyde polymer, and orthoester.

8. The composition of claim 5 wherein $R_1$, $R_2$, $R_3$, $R_4$, $R_5$, $R_6$, $R_7$, $R_8$, $R_9$, $R_{10}$, and $R_{11}$ are the same or different monovalent radical derived from an aliphatic, alicyclic, or aromatic compound comprising from 1 to about 10 carbon atoms.

9. The composition of claim 7 wherein $R_1$, $R_2$, $R_3$, $R_4$, $R_5$, $R_6$, $R_7$, $R_8$, $R_9$, $R_{10}$, and $R_{11}$ are the same or different monovalent radical derived from an aliphatic, alicyclic, or aromatic compound comprising from 1 to about 10 carbon atoms.

10. The composition of claim 7 wherein $R_1$, $R_2$, $R_3$, $R_4$, $R_5$, $R_6$, $R_7$, $R_8$, $R_9$, $R_{10}$, and $R_{11}$ are the same or different monovalent radical derived from an aliphatic or alicyclic compound comprising from 1 to about 10 carbon atoms.

11. The composition of claim 7 wherein $R_1$, $R_2$, $R_3$, $R_4$, $R_5$, $R_6$, $R_7$, $R_8$, $R_9$, $R_{10}$, and $R_{11}$ are the same or different alkyl, alkenyl, or alkynyl radical comprising from 1 to about 10 carbon atoms.

12. The composition of claim 11 wherein the hydrocarbon fuel is a petroleum middle distillate fuel or residual fuel.

13. The composition of claim 11 wherein the hydrocarbon fuel is propane.

14. The composition of claim 11 wherein the hydrocarbon fuel is diesel fuel or heating oil.

15. The composition of claim 11 wherein the hydrocarbon fuel is acetylene.

16. A composition comprising:

a middle distillate hydrocarbon fuel; and from about 0.05 to about 10 volume percent of at least one cyclic aldehyde polymer and of at least one orthoester based upon the volume of hydrocarbon fuel, cyclic aldehyde polymer, and orthoester.

17. The composition of claim 16 wherein the orthoester is of the formulae:

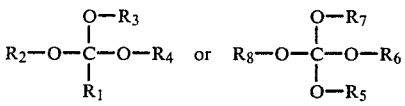

wherein $R_1$ is hydrogen or a $C_1$ to $C_{20}$ organic radical, and $R_2$, $R_3$, $R_4$, $R_5$, $R_6$, $R_7$, and $R_8$ are the same or different $C_1$ to $C_{20}$ monovalent organic radical.

18. The composition of claim 17 wherein the cyclic aldehyde polymer is of the formula:

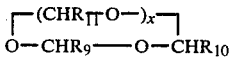

where $R_9$, $R_{10}$, and $R_{11}$ are hydrogen or the same or different $C_1$ to $C_{10}$ organic radical and x is from 0 to 4, wherein when x is 2 to 4, $R_{11}$ is the same or different $C_1$ to $C_{20}$ organic radical of each repeating segment.

19. The composition of claim 18 wherein the cyclic aldehyde polymer is from about 0.1 to about 50 weight percent of the total amount of cyclic aldehyde polymer and orthoester.

20. The composition of claim 19 wherein $R_1$, $R_2$, $R_3$, $R_4$, $R_5$, $R_6$, $R_7$, $R_8$, $R_9$, $R_{10}$, and $R_{11}$ are the same or different monovalent radical derived from an aliphatic, alicyclic, or aromatic compound comprising from 1 to about 10 carbon atoms.

21. The composition of claim 19 wherein $R_1$, $R_2$, $R_3$, $R_4$, $R_5$, $R_6$, $R_7$, $R_8$, $R_9$, $R_{10}$, and $R_{11}$ are the same or different monovalent radical derived from an aliphatic or alicyclic comprising from 1 to about 10 carbon atoms.

22. The composition of claim 19 wherein $R_1$, $R_2$, $R_3$, $R_4$, $R_5$, $R_6$, $R_7$, $R_8$, $R_9$, $R_{10}$, and $R_{11}$ are the same or different alkyl, alkenyl, or alkynyl radical comprising from 1 to about 10 carbon atoms.

23. The composition of claim 21 wherein the total amount of cyclic aldehyde polymer and orthoester is from about 0.1 to about 5 volume percent of the total volume of the hydrocarbon fuel, cyclic aldehyde and orthoester.

24. The composition of claim 22 wherein the total amount of cyclic aldehyde polymer and orthoester is from about 0.1 to about 5 volume percent of the total volume of hydrocarbon fuel, cyclic aldehyde polymer and orthoester.

25. The composition of claims 21 22, or 24 wherein the middle distillate fuel is a diesel fuel.

26. A method of reducing the particulate emissions from the combustion of a gaseous or liquid hydrocarbon fuel comprising combusting a mixture of the hydrocarbon fuel and a particulate reducing amount of at least one cyclic aldehyde polymer and at least one orthoester.

27. The method of claim 26 wherein the orthoester is of the formulae:

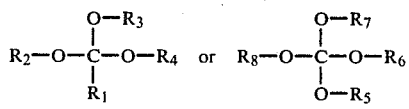

wherein $R_1$ is hydrogen or a monovalent $C_1$ to $C_{20}$ organic radical, $R_2$, $R_3$, $R_4$, $R_5$, $R_6$, $R_7$, and $R_8$ are the same or different $C_1$ to $C_{20}$ monovalent organic radical.

28. The method of claim 27 wherein the cyclic aldehyde polymer is of the formula:

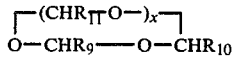

where $R_9$, $R_{10}$, and $R_{11}$ are hydrogen or the same or different $C_1$ to $C_{10}$ organic radical and x is from 0 to 4, wherein when x is 2 to 4, $R_{11}$ is the same or different $C_1$ to $C_{10}$ organic radical of each repeating segment.

29. The method of claim 28 wherein the cyclic aldehyde polymer is from about 0.1 to about 50 weight percent of the total amount of cyclic aldehyde polymer and orthoester.

30. The method of claim 29 wherein the total amount of cyclic aldehyde polymer and orthoester is admixed with the hydrocarbon fuel in an amount from about 0.05 to about 49 volume percent of the total volume of hydrocarbon fuel, cyclic aldehyde polymer and orthoester.

31. The method of claim 29 wherein the total amount of cyclic aldehyde polymer and orthoester is admixed with the hydrocarbon fuel in an amount from about 0.05 to about 10 volume percent of the total volume of hydrocarbon fuel, and cyclic aldehyde polymer and orthoester.

32. The method of claim 28 wherein the total amount of cyclic aldehyde polymer and orthoester is admixed with the hydrocarbon fuel in an amount of from about 0.1 to about 5 volume percent of the total volume of hydrocarbon fuel, cyclic aldehyde polymer, and orthoester.

33. The method of claim 29 wherein the total amount of cyclic aldehyde polymer and orthoester is admixed with the hydrocarbon fuel in an amount of from about 0.1 to about 5 volume percent of the total volume of hydrocarbon fuel, cyclic aldehyde polymer, and orthoester.

34. The method of claim 32 wherein $R_1$, $R_2$, $R_3$, $R_4$, $R_5$, $R_6$, $R_7$, $R_8$, $R_9$, $R_{10}$, and $R_{11}$ are the same or different monovalent radical derived from an aliphatic or alicyclic compound comprising from 1 to about 10 carbon atoms.

35. The method of claim 32 wherein $R_1$, $R_2$, $R_3$, $R_4$, $R_5$, $R_6$, $R_7$, $R_8$, $R_9$, $R_{10}$, and $R_{11}$ are the same or different alkyl, alkenyl, or alkynyl radical comprising from 1 to about 10 carbon atoms.

36. The method of claims 34 wherein the hydrocarbon fuel is diesel fuel.

37. The method of claim 36 wherein the hydrocarbon fuel is combusted in a diesel engine.

38. A composition as defined in claim 2, 3, 9, 11, 18, 19, 20, or 23 wherein said orthoester is of formula:

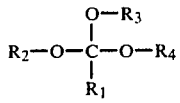

39. A composition as defined in claim 2, 3, 9, 11, 18, 19, 20, or 23 wherein said orthoester is of formula:

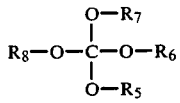

* * * * *